US008840011B2

(12) United States Patent
Kohler

(10) Patent No.: US 8,840,011 B2
(45) Date of Patent: Sep. 23, 2014

(54) CARTON WITH REINFORCED CORNER

(75) Inventor: Karl A. Kohler, Bartlett, IL (US)

(73) Assignee: Graphic Packaging International, Inc., Atlanta, GA (US)

( * ) Notice: Subject to any disclaimer, the term of this patent is extended or adjusted under 35 U.S.C. 154(b) by 313 days.

(21) Appl. No.: 13/166,019

(22) Filed: Jun. 22, 2011

(65) Prior Publication Data

US 2011/0315750 A1 Dec. 29, 2011

Related U.S. Application Data

(60) Provisional application No. 61/358,180, filed on Jun. 24, 2010, provisional application No. 61/364,185, filed on Jul. 14, 2010.

(51) Int. Cl.

| | |
|---|---|
| ***B65D 17/353*** | (2006.01) |
| ***B65D 5/52*** | (2006.01) |
| ***B65D 5/54*** | (2006.01) |

(52) U.S. Cl.

CPC *B65D 5/548* (2013.01); *B65D 5/52* (2013.01); *Y10S 229/918* (2013.01); *Y10S 229/919* (2013.01)

USPC ..... 229/242; 229/164; 229/918; 229/919; 206/736; 206/774

(58) Field of Classification Search

USPC ..... 229/164, 240, 242, 918–919; 206/736, 206/774, 427, 429, 431

See application file for complete search history.

(56) References Cited

U.S. PATENT DOCUMENTS

| | | | |
|---|---|---|---|
| 1,656,919 | A | 1/1928 | Marsh |
| 1,901,483 | A | 3/1933 | Ware, Jr. |
| 1,925,102 | A | 9/1933 | Levkoff |
| 2,027,079 | A | 1/1936 | Weiss |
| 2,141,743 | A | 12/1938 | Ethridge |
| 2,145,430 | A | 1/1939 | New |
| 2,152,079 | A | 3/1939 | Mott |
| 2,684,178 | A | 7/1954 | Keeler |
| 2,704,617 | A | 3/1955 | Stieve |
| 3,002,613 | A | 10/1961 | Merkel et al. |
| 3,258,152 | A | 6/1966 | Cameron |

(Continued)

FOREIGN PATENT DOCUMENTS

| | | |
|---|---|---|
| DE | 2 320 190 | 11/1973 |
| EP | 0 704 386 A1 | 4/1996 |

(Continued)

*Primary Examiner* — Gary Elkins
*Assistant Examiner* — Scott McNurlen
(74) *Attorney, Agent, or Firm* — Womble Carlyle Sandridge & Rice, LLP

(57) ABSTRACT

A carton for containing a plurality of articles. The carton comprises a bottom panel, a first side panel, and a second side panel. At least one end flap comprises a first portion foldably connected to the one of the first side panel and the second side panel, a second portion foldably connected to the first portion, and a third portion foldably connected to the second portion. The carton has at least one reinforced corner that comprises a reinforced end panel and a reinforced portion of one of the first side panel and the second side panel. The reinforced end panel comprises the second portion and the third portion of the at least one end flap. The reinforced portion comprises the third portion of the at least one end flap and a portion of the one of the first side panel and the second side panel.

30 Claims, 13 Drawing Sheets

(56) References Cited

U.S. PATENT DOCUMENTS

| | | | | | |
|---|---|---|---|---|---|
| 3,276,665 | A | | 10/1966 | Rasmussen | |
| 3,280,968 | A | | 10/1966 | Craine | |
| 3,511,434 | A | | 5/1970 | Dews | |
| 3,554,402 | A | | 1/1971 | Lock | |
| 3,578,238 | A | | 5/1971 | Schillinger et al. | |
| 3,653,495 | A | | 4/1972 | Gray | |
| 3,677,458 | A | | 7/1972 | Gosling | |
| 3,688,972 | A | | 9/1972 | Mahon | |
| 3,759,378 | A | | 9/1973 | Werth | |
| 3,786,914 | A | | 1/1974 | Beutler | |
| 3,833,116 | A | * | 9/1974 | Howe | 206/431 |
| 3,884,348 | A | | 5/1975 | Ross | |
| 3,904,036 | A | | 9/1975 | Forrer | |
| 4,008,849 | A | | 2/1977 | Baber | |
| 4,039,120 | A | | 8/1977 | Herzog | |
| 4,113,100 | A | | 9/1978 | Soja et al. | |
| 4,201,322 | A | | 5/1980 | Crawford | |
| 4,295,598 | A | | 10/1981 | Calvert | |
| 4,327,829 | A | | 5/1982 | Hughes | |
| 4,533,052 | A | | 8/1985 | Fruchey et al. | |
| 4,558,785 | A | | 12/1985 | Gordon | |
| 4,742,917 | A | | 5/1988 | Bornwasser | |
| 4,773,541 | A | | 9/1988 | Riddell | |
| 4,815,609 | A | | 3/1989 | Kiedaisch | |
| 4,886,160 | A | | 12/1989 | Kligerman | |
| 5,029,698 | A | | 7/1991 | Stout | |
| 5,065,937 | A | | 11/1991 | Ritter | |
| 5,156,269 | A | | 10/1992 | Bakx | |
| 5,181,650 | A | | 1/1993 | Hollander et al. | |
| 5,197,598 | A | | 3/1993 | Stout et al. | |
| 5,246,112 | A | | 9/1993 | Stout et al. | |
| 5,400,955 | A | | 3/1995 | Coalier et al. | |
| 5,582,345 | A | * | 12/1996 | Lankhuijzen | 229/235 |
| 5,588,585 | A | * | 12/1996 | McClure | 229/191 |
| 5,647,483 | A | | 7/1997 | Harris | |
| 5,699,957 | A | | 12/1997 | Blin et al. | |
| 5,704,470 | A | | 1/1998 | Sutherland | |
| 5,842,576 | A | | 12/1998 | Snow | |
| 5,857,570 | A | | 1/1999 | Brown | |
| 5,881,884 | A | | 3/1999 | Podosek | |
| 5,921,398 | A | | 7/1999 | Carroll | |
| 5,927,498 | A | | 7/1999 | Saam | |
| 5,941,377 | A | | 8/1999 | Hart et al. | |
| 5,979,749 | A | | 11/1999 | Bozich | |
| 6,041,920 | A | | 3/2000 | Hart et al. | |
| 6,105,853 | A | | 8/2000 | Lamare | |
| 6,129,211 | A | | 10/2000 | Prakken et al. | |
| 6,135,289 | A | | 10/2000 | Miller | |
| 6,227,367 | B1 | | 5/2001 | Harrelson et al. | |
| 6,419,152 | B1 | | 7/2002 | Tokarski | |
| 6,435,351 | B1 | | 8/2002 | Gibb | |
| 6,478,159 | B1 | | 11/2002 | Taylor et al. | |
| 6,510,982 | B2 | | 1/2003 | White | |
| 6,523,692 | B2 | | 2/2003 | Gregory | |
| 6,536,656 | B2 | | 3/2003 | Auclair et al. | |
| 6,631,803 | B2 | | 10/2003 | Rhodes et al. | |
| 6,695,137 | B2 | | 2/2004 | Jones et al. | |
| 6,729,475 | B2 | * | 5/2004 | Yuhas et al. | 206/746 |
| 6,869,009 | B2 | | 3/2005 | Sutherland et al. | |
| 6,968,992 | B2 | | 11/2005 | Schuster | |
| 6,981,632 | B2 | * | 1/2006 | Gardner et al. | 229/240 |
| 7,118,023 | B2 | * | 10/2006 | Holdsworth | 229/164 |
| 7,128,206 | B2 | | 10/2006 | Kohler | |
| 7,152,777 | B2 | * | 12/2006 | McClure | 229/143 |
| 7,225,930 | B2 | | 6/2007 | Ford et al. | |
| 7,552,820 | B2 | | 6/2009 | Kohler | |
| 7,959,063 | B2 | * | 6/2011 | McLeod | 229/143 |
| 2002/0043554 | A1 | | 4/2002 | White | |
| 2002/0170845 | A1 | | 11/2002 | Olifff | |
| 2003/0222131 | A1 | * | 12/2003 | Justice | 229/200 |
| 2004/0124111 | A1 | * | 7/2004 | Bevier | 206/509 |
| 2005/0103651 | A1 | | 5/2005 | Lebras | |
| 2005/0211577 | A1 | | 9/2005 | Bakx | |
| 2005/0230273 | A1 | | 10/2005 | Kohler | |
| 2006/0006216 | A1 | * | 1/2006 | Moll et al. | 229/235 |
| 2006/0138206 | A1 | * | 6/2006 | Keefe et al. | 229/179 |
| 2006/0231603 | A1 | * | 10/2006 | McLeod | 229/141 |
| 2009/0266873 | A1 | * | 10/2009 | Ledvina | 229/108 |
| 2010/0308104 | A1 | | 12/2010 | Kohler | |
| 2012/0091031 | A1 | * | 4/2012 | Pinkstone | 206/736 |

FOREIGN PATENT DOCUMENTS

| | | |
|---|---|---|
| FR | 1 379 931 | 11/1964 |
| GB | 1 218 016 | 1/1971 |
| WO | WO 99/31593 | 6/1999 |
| WO | WO 03/082686 A1 | 10/2003 |
| WO | WO 2004/063031 A1 | 7/2004 |

* cited by examiner 205
234
226
230
277
103
41
21
43
101
111
222
273
17
212
113
107
105
47
45
23

CARTON WITH REINFORCED CORNER

CROSS-REFERENCE TO RELATED APPLICATIONS

This application claims the benefit of U.S. Provisional Application No. 61/358,180, which was filed on Jun. 24, 2010, and U.S. Provisional Application No. 61/364,185, which was filed on Jul. 14, 2010.

INCORPORATION BY REFERENCE

U.S. Provisional Patent Application No. 61/358,180, which was filed on Jun. 24, 2010, and U.S. Provisional Application No. 61/364,185, which was filed on Jul. 14, 2010, are hereby incorporated by reference for all purposes as if presented herein in their entirety.

BACKGROUND OF THE DISCLOSURE

The present disclosure generally relates to packages or cartons for holding, displaying, carrying, and dispensing containers.

SUMMARY OF THE DISCLOSURE

In general, one aspect of the disclosure is generally directed to a carton for containing a plurality of articles. The carton comprises a plurality of panels that extends at least partially around an interior of the carton. The interior is for containing the plurality of articles. The plurality of panels comprises a bottom panel, a first side panel foldably connected to the bottom panel, and a second side panel foldably connected to the bottom panel. At least one end flap is foldably connected to one of the first side panel and the second side panel. The at least one end flap comprises a first portion foldably connected to the one of the first side panel and the second side panel. A second portion foldably is connected to the first portion. A third portion is foldably connected to the second portion. The carton has at least one reinforced corner that comprises a reinforced end panel and a reinforced portion of one of the first side panel and the second side panel. The reinforced end panel comprises the second portion and the third portion of the at least one end flap that are in face-to-face contact. The reinforced portion of the one of the first side panel and the second side panel comprises the third portion of the at least one end flap that is in face-to-face contact with a portion of the one of the first side panel and the second side panel.

In another aspect, the disclosure is generally directed to a blank for forming a carton for containing a plurality of articles. The blank comprises a plurality of panels that are for forming an interior of the carton formed from the blank. The plurality of panels comprises a bottom panel, a first side panel foldably connected to the bottom panel, and a second side panel foldably connected to the bottom panel. At least one end flap is foldably connected to one of the first side panel and the second side panel. The at least one end flap comprises a first portion foldably connected to the one of the first side panel and the second side panel, a second portion foldably connected to the first portion, and a third portion foldably connected to the second portion. The at least one end flap is for forming at least one reinforced corner of the carton formed from the blank that comprises a reinforced end panel and a reinforced portion of one of the first side panel and the second side panel. The reinforced end panel comprises the second portion and the third portion of the at least one end flap that are in face-to-face contact in the carton formed from the blank. The reinforced portion of the one of the first side panel and the second side panel comprises the third portion of the at least one end flap that is in face-to-face contact with a portion of the one of the first side panel and the second side panel in the carton formed from the blank.

In another aspect, the disclosure is generally directed to a method of forming a carton for containing a plurality of articles. The method comprises obtaining a blank. The blank comprises a bottom panel, a first side panel foldably connected to the bottom panel, a second side panel foldably connected to the bottom panel, at least one end flap foldably connected to one of the first side panel and the second side panel, the at least one end flap comprises a first portion foldably connected to the one of the first side panel and the second side panel, a second portion foldably connected to the first portion, and a third portion foldably connected to the second portion. The method comprises positioning the blank to form the carton. The positioning the blank comprises forming at least one reinforced corner that comprises a reinforced end panel and a reinforced portion of one of the first side panel and the second side panel. Forming the reinforced end panel comprises placing the second portion and the third portion in face-to-face contact. Forming the reinforced portion of the one of the first side panel and the second side panel comprises placing the third portion of the at least one end flap in face-to-face contact with a portion of the one of the first side panel and the second side panel.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout at least some of the drawings included with the disclosure.

DETAILED DESCRIPTION OF THE EXEMPLARY EMBODIMENTS

The present disclosure generally relates to cartons, trays, packages, constructs, sleeves, or the like, for shipping, holding, displaying, and dispensing articles such as containers, cartons, or packages holding food products, for example. The containers can be made from materials suitable in composition for packaging the particular food item, and the materials can include, but are not limited to, cardboard, paperboard, plastics such as PET, LDPE, LLDPE, HDPE, PP, PS, PVC, EVOH, and Nylon, and the like, or other suitable materials. Furthermore, the articles can be containers, cartons, or packages holding non-food products without departing from the disclosure.

Cartons according to the present disclosure can accommodate articles or containers of numerous different shapes. For the purpose of illustration and not for the purpose of limiting the scope of the disclosure, the following detailed description describes food product containers at least partially disposed within the carton embodiments. In this specification, the terms "lower," "bottom," "upper," "top," "side," "front," and "back" indicate orientations determined in relation to fully erected cartons, and such terms are not intended to limit the scope of the disclosure.

Figure 5:
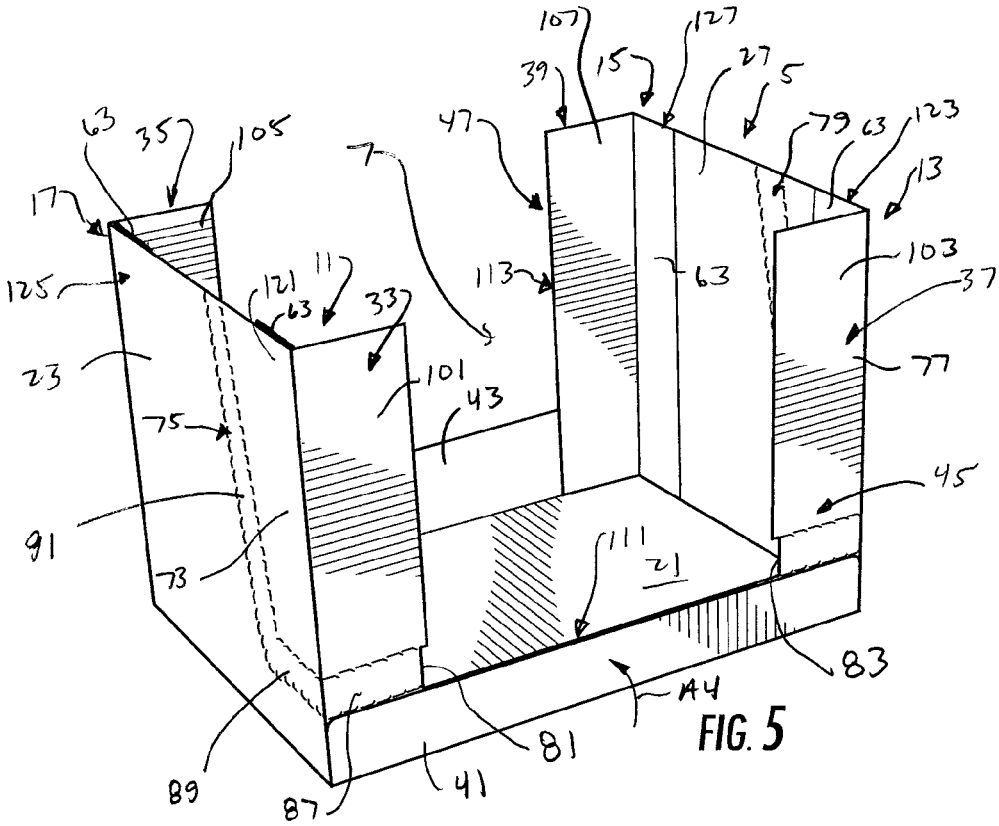
Figure 6:
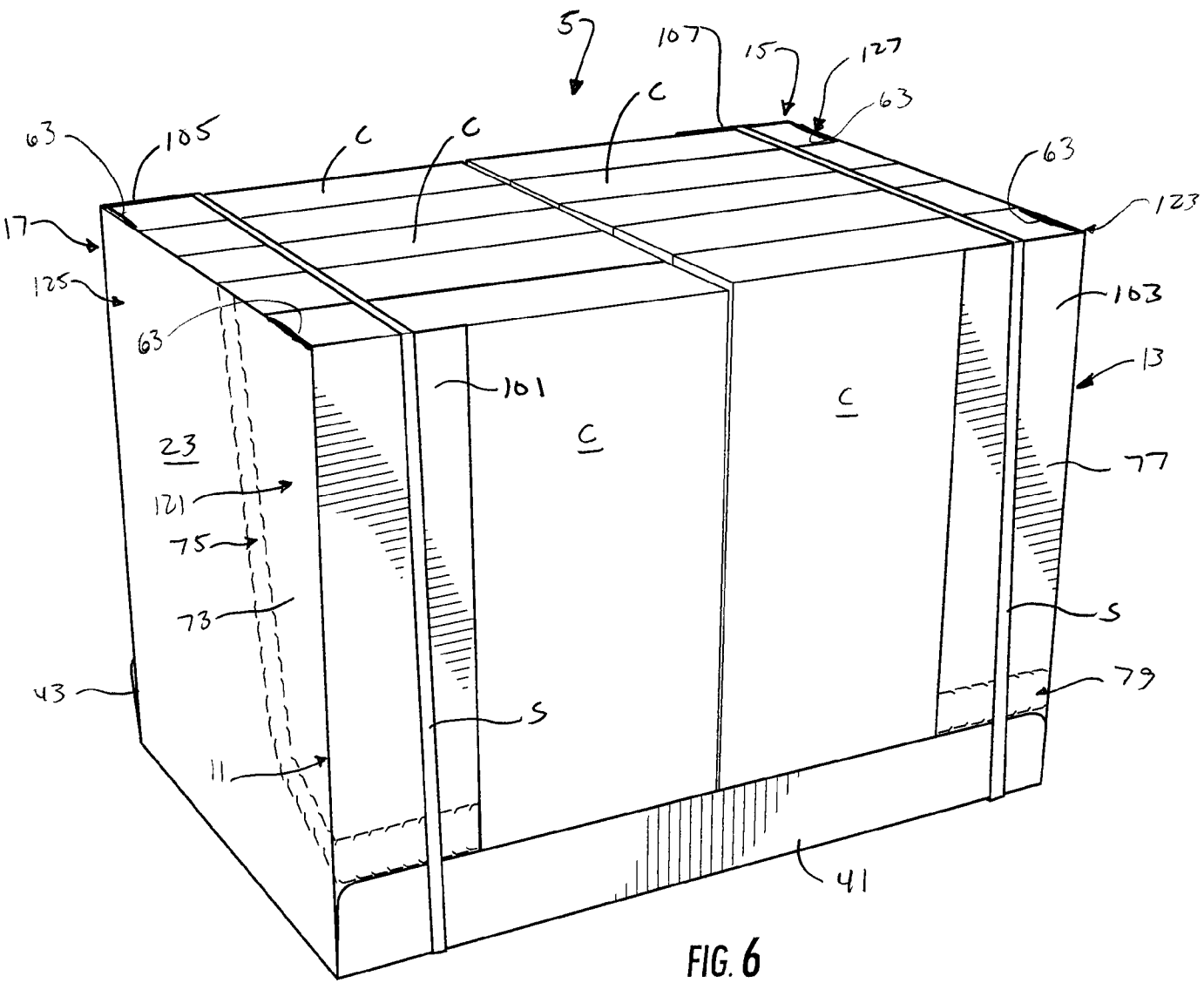
FIG. 6 is a perspective view of the carton of the first embodiment loaded with articles and having retention features.

A carton 5 of a first embodiment is illustrated in FIGS. 5 and 6, with FIG. 6 illustrating articles in the form of food product containers or packages C received in the interior 7 of the carton. In one embodiment, the containers C are illustrated as ten food containers (e.g., cereal boxes) housed in the carton 5. Less than or more than ten containers C can be held in the carton 5, and the containers can be otherwise sized and shaped without departing from the disclosure. Further, articles other than food product containers C can be placed in the interior 7 of the carton 5 without departing from the disclosure. As described in detail below, the carton 5 of the illustrated embodiment has four reinforced corners 11, 13, 15, 17 that have features that increase the strength of the carton 5 to facilitate stacking of the loaded cartons 5 without failure of the carton or damage to the containers C.

As described below, the containers C are contained in the carton 5 for shipping to a point-of-sale vendor (e.g., grocery store) where the carton 5 can be converted to a display or dispensing unit 12 (FIGS. 8 and 9) for displaying and dispensing the containers to consumers. Further, the carton 5 can be otherwise handled or shipped (e.g., directly to a customer after loading) without departing from the disclosure.

Figure 1:
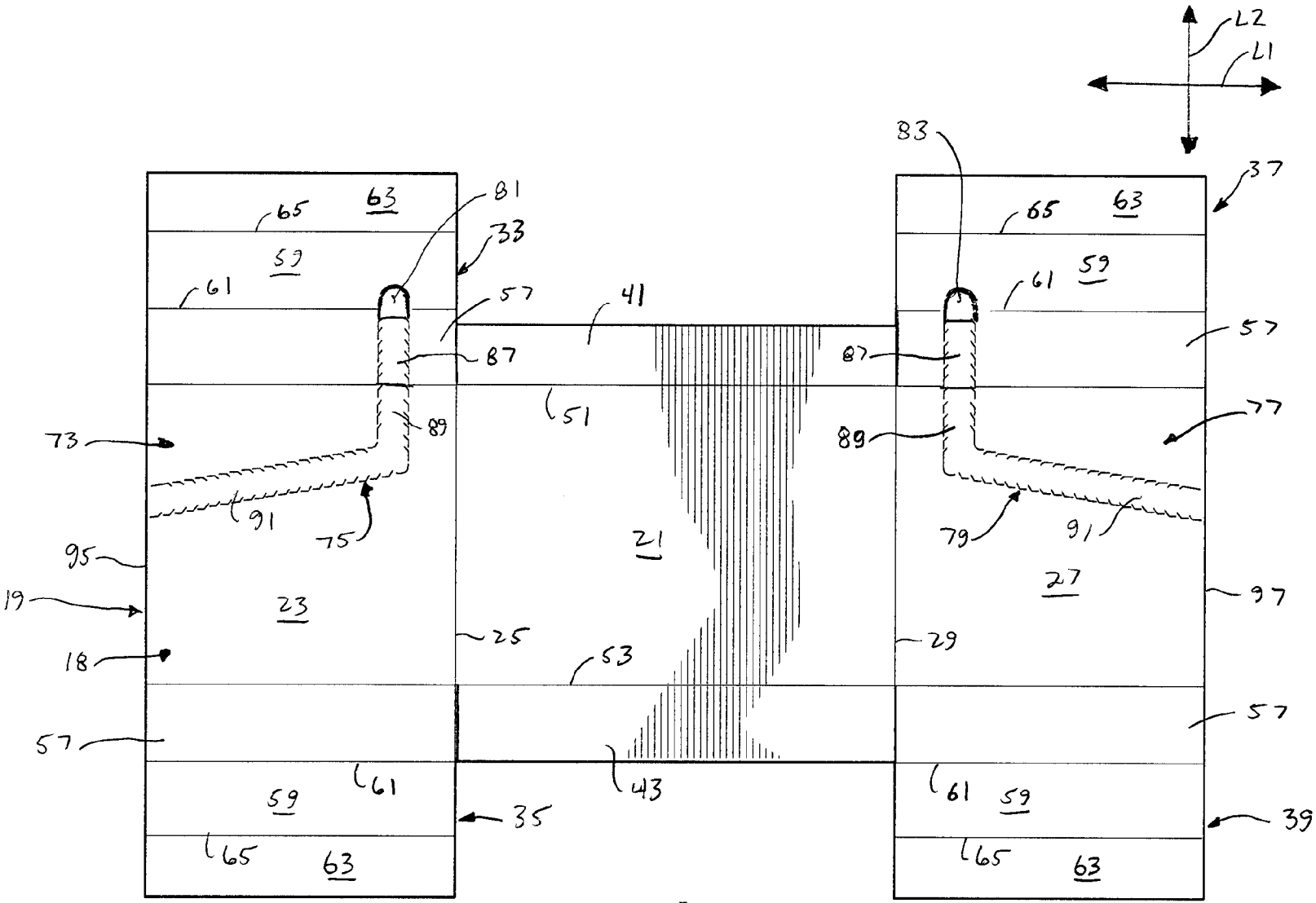
FIG. 1 is a plan view of an exterior surface of a blank for forming a carton according to a first embodiment of the disclosure.
Figure 1A:
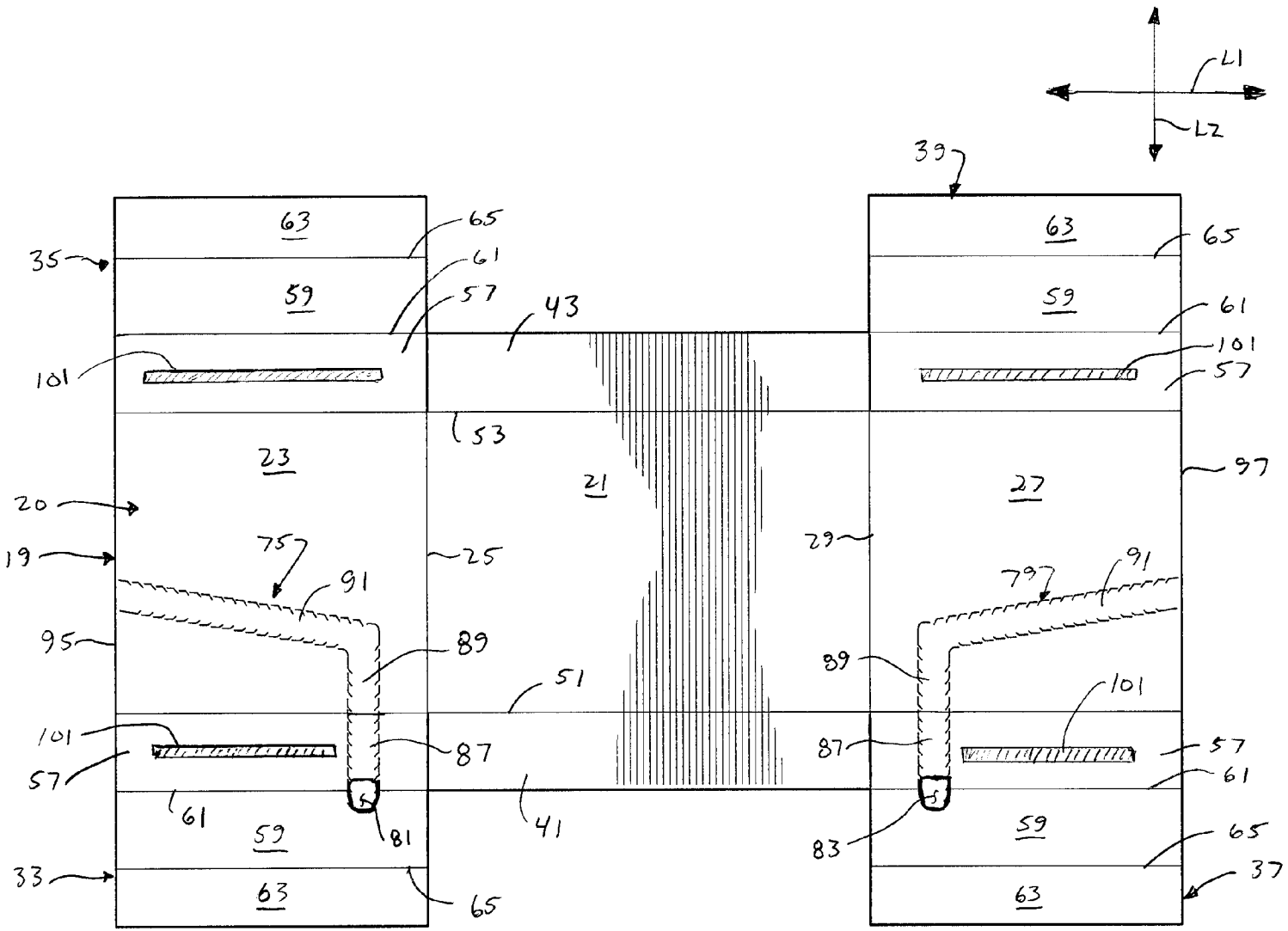
FIG. 1A is a plan view of an interior surface of the blank of FIG. 1.

FIG. 1 is a plan view of an exterior side 18 of a blank 19 used to form the carton 5, and FIG. 1A is a plan view of the blank showing the interior surface 20. The blank 19 has a longitudinal axis L1 and a lateral axis L2. The blank 19 comprises a bottom panel 21 foldably connected to a first side panel 23 at a first transverse fold line 25, and a second side panel 27 foldably connected to the bottom panel 21 at a second transverse fold line 29. In the illustrated embodiment, the first side panel 23 is foldably connected to a first side end flap 33 and a second side end flap 35. The second side panel 27 is foldably connected to a first side end flap 37 and a second side end flap 39. As shown in FIG. 1, the bottom panel 21 is foldably connected to a first bottom end flap 41 and a second bottom end flap 43. When the carton 5 is erected, the first side end flaps 33, 37 and first bottom end flap 41 at least partially close a first, front end 45 of the carton 5, and the second side end flaps 35, 39 and second bottom end flap 43 close a second, back end 47 of the carton. In accordance with alternative embodiments of the present disclosure, different flap arrangements can be used for closing the ends 45, 47 of the carton 5.

In the illustrated embodiment, the first side end flaps 33, 37 and bottom end flap 41 extend along a first marginal area of the blank 19, and can be foldably connected to a respective side panel 23, 27 or bottom panel 21 at a first longitudinal fold line 51 that extends along the length of the blank. The second side end flaps 35, 39 and the second bottom end flap 43 extend along a second marginal area of the blank 19, and can be foldably connected to a respective side panel 23, 27 or bottom panel 21 at a second longitudinal fold line 53 that also extends along the length of the blank. The longitudinal fold lines 51, 53 may be, for example, substantially straight, or offset at one or more locations to account for blank thickness or for other factors.

As shown in FIG. 1, each of the first and second side end flaps 33, 35, 37, 39 have substantially similar features and like features will be given like reference numbers for each of the side end flaps. One or more of the side end flaps 33, 35, 37, 39 could be otherwise shaped, arranged, and/or configured to have different features than one or more of the other side end flaps without departing from this disclosure. Each of the first and second side end flaps 33, 35, 37, 39 comprises a first portion 57 foldably connected to one of the first side panel 23 or the second side panel 27 at a respective longitudinal fold line 51, 53. A second portion 59 of a respective side end flap 33, 35, 37, 39 is foldably connected to the first portion 57 at a respective longitudinal fold line 61. A third portion 63 of a respective side end flap 33, 35, 37, 39 is foldably connected to the second portion 59 at a respective longitudinal fold line 65. In one embodiment, the first portion 57, second portion 59, and third portion 63 are generally rectangular and the fold lines 61, 65 are both generally parallel to each longitudinal fold line 51, 53. The side end flaps 33, 35, 37, 39 could be otherwise shaped, arranged, and/or configured without departing from the disclosure. For example, one or more of the side end flaps 33, 35, 37, 39 could comprises only a single portion foldably connected to a respective one of the first side panel 23 or the second side panel 27 without departing from the disclosure.

In the illustrated embodiment, the blank 19 includes a first removable section, generally indicated at 73, removably attached to the blank 19 at a first tear strip (broadly "line of separation"), generally indicated at 75, and a second removable section indicated at 77, removably attached to the blank 19 at a second tear strip (broadly "line of separation"), generally indicated at 79. In one embodiment, the removable sections 73 and 77 and the tear strips 75, 79 are similarly shaped and can be generally a mirror-image of each other, therefore, like reference numbers will be used to identify like components of the two removable sections and tear strips. One or both of the removable sections 73, 77 could be otherwise shaped, arranged, and/or configured without departing from the disclosure. Further, one or both of the removable sections 73, 77 could be omitted from the blank 17 without departing from the disclosure.

In one embodiment, each of the removable sections 73, 77 comprises a portion of one of the side end flaps 33, 37 and a portion of one of the side panels 23, 27 and is partially defined by an access opening 81, 83 in a respective end flap 33, 37. The access opening 81, 83 is adjacent a respective edge of the tear strip 75, 79 with a first portion 87 of each tear strip extending from the access opening in the lateral direction across the first portion 57 of each end flap 33, 37 to the longitudinal fold line. A second portion 89 of each tear strip 75, 79 extends from the first portion 87 into a respective side panel 23, 27. A third portion 91 of each tear strip 75, 79 extends from the second portion 89 across the side panel 23, 27 to an edge of a respective side panel corresponding with a respective longitudinal end edge 95, 97 of the blank 19. In one embodiment, the first portion 87 and the second portion 89 of the tear strip extend generally in the lateral direction L2 and the third portion 91 extends in a direction that is generally oblique to the lateral direction. As will be discussed in further detail below, each of the removable sections 73, 77 can be removed from the carton 5 to convert the carton from a shipping configuration to a display configuration. In the illustrated embodiment, each of the tear strips 75, 79 comprises two spaced apart tear lines, but the tear strips could be other lines of weakening (e.g., a single tear line) without departing from the disclosure. Further, the access openings 81, 83 could be otherwise shaped, arranged, and/or omitted, or the access openings could be access panels foldably connected to the tear strips 75, 79, that are folded to initiate removal of the tear strips 75, 79.

Figure 2:
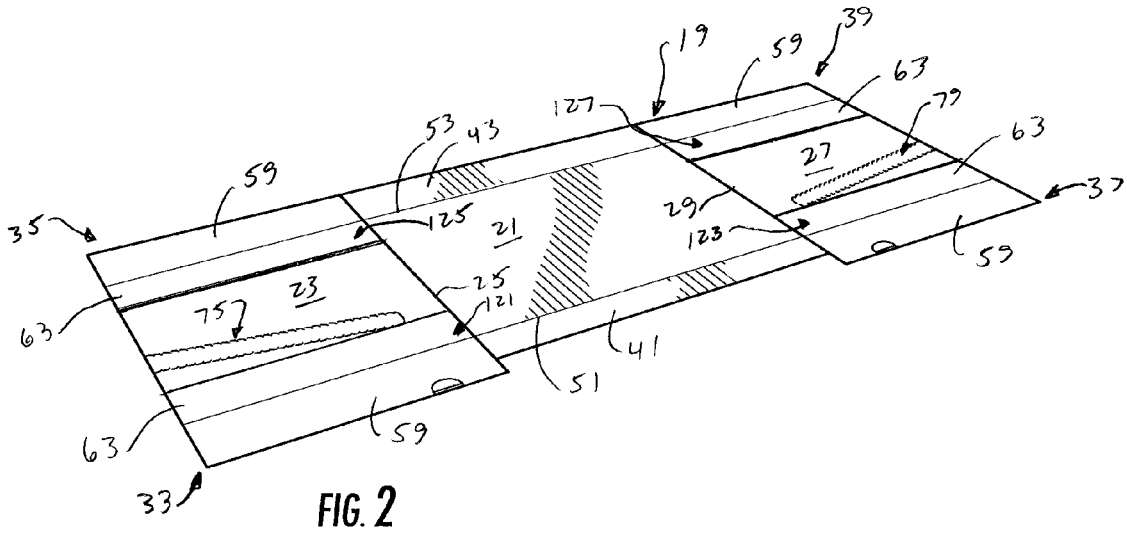
FIGS. 2-5 are various views of the blank and/or carton of the first embodiment in various states of assembly.
Figure 3:
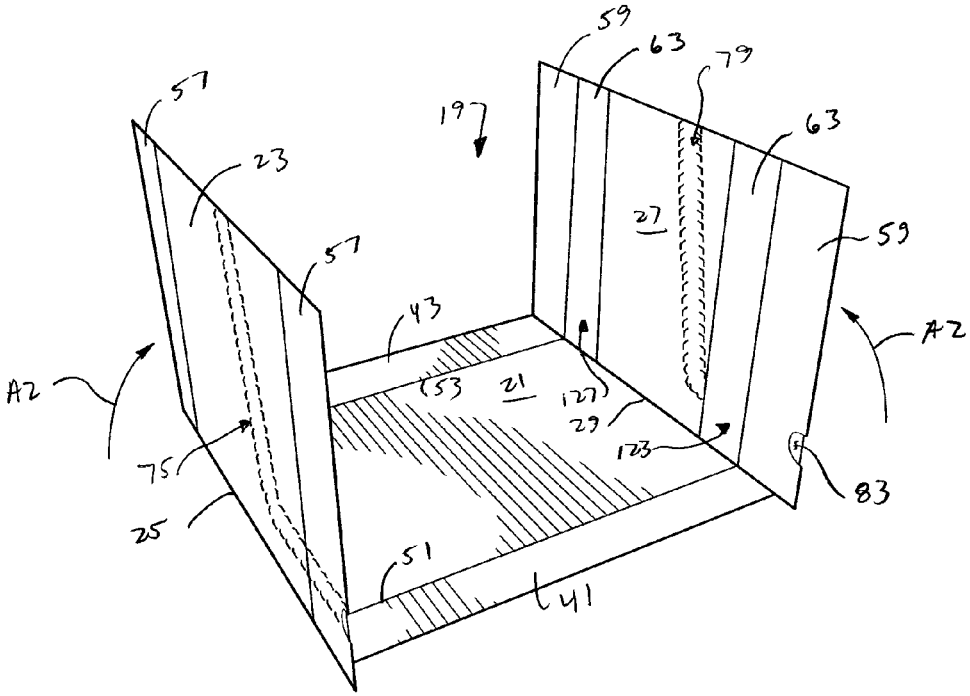

In accordance with one exemplary embodiment, the blank 19 can be erected into the carton 5 by first positioning the blank with the interior surface 20 facing up, as shown in FIG. 1A. Glue or other adhesive 101 can be placed on a respective first portion 57 of the end flaps 33, 35, 37, 39, or the adhesive can be omitted or otherwise located without departing from the disclosure. The second and third portions 59, 63 of the side end flaps 33, 35, 37, 39 are folded together along fold lines 61 approximately 180 degrees so that the second portion 59 is in face-to-face contact with the first portion 57 of the side end flaps 33, 35, 37, 39 and the third portion 63 is in face-to-face contact with a portion of a respective side panel 23, 27 (FIG. 2). In one embodiment, the glue 101 adhesively connects the first portion 57 and the second portion 59 of each side end flap 33, 35, 37, 39 in face-to-face contact with each other. Next, the side panels 23, 27 can be upwardly folded approximately 90 degrees relative to the bottom panel 21 by folding along respective fold lines 25, 29 in the direction of arrows A2 (FIG. 3). The positioning of the third portion 63 of each of the side end flaps 33, 35, 37, 39 forms a respective reinforced portion 121, 123, 125, 127 of a respective side panel 23, 27.

Figure 4:
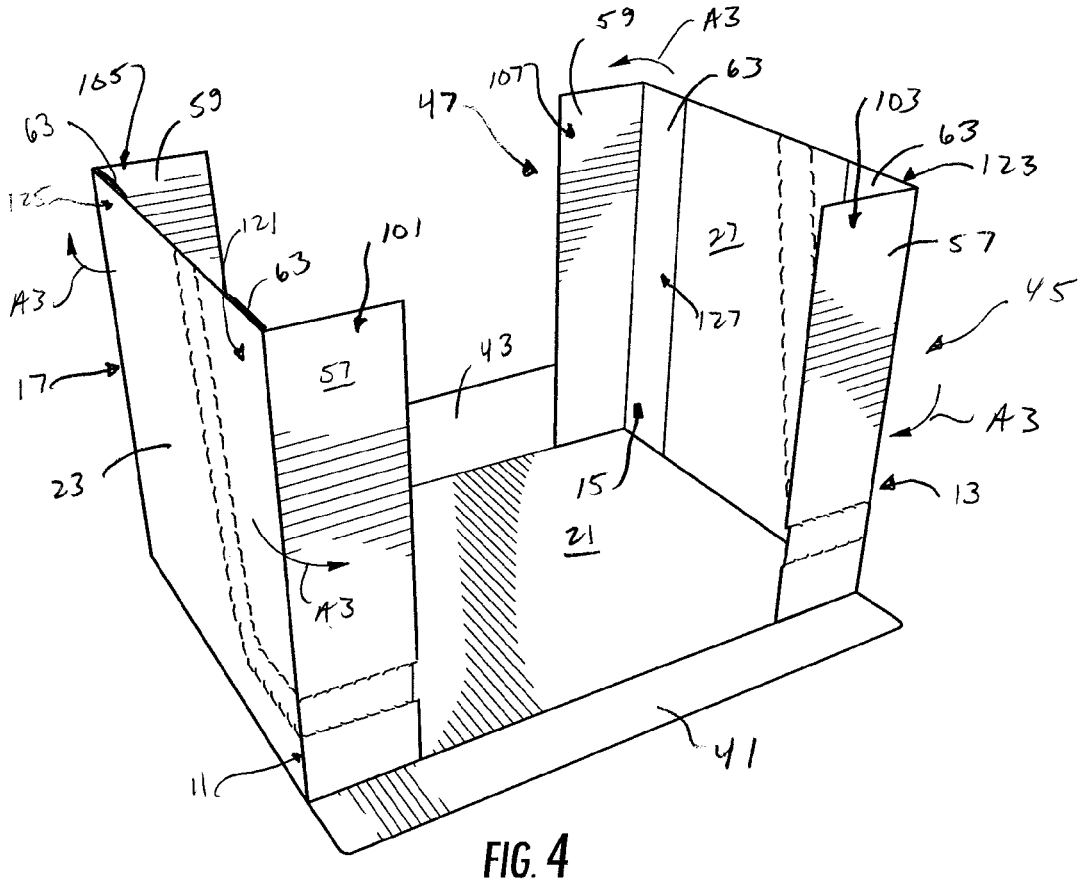

As shown in FIG. 4, the overlapped first portion 57 and second portion 59 of each side end flap 33, 35, 37, 39 can be folded approximately 90 degrees relative to the bottom panel 21 about respective fold line 51, 53 in the direction of arrows A3 so that the overlapped portions 57, 59 are folded inward to form two reinforced end panels 101, 103 at the front end 45 of the carton 5 and two reinforced end panels 105, 107 at the back end 47 of the carton. In one embodiment, the front bottom end flap 41 is upwardly folded approximately 90 degrees relative to the bottom panel 21 in the direction of arrow A4 (FIG. 5) to cooperate with the front end panels 101, 103 to partially close the front end 45 of the carton. The back bottom end flap 43 is upwardly folded approximately 90 degrees relative to the bottom panel 21 to cooperate with the back end panels 105, 107 to partially close the back end 47 of the carton 5. In one embodiment, the front end 45 of the carton 5 and the back end 47 of the carton both have a respective generally U-shaped opening 111, 113. Alternatively, one or more of the end panels 101, 103, 105, 107 and bottom end flaps 41, 43 could be otherwise shaped and/or configured so that the front end 45 and/or back end 47 is alternatively shaped or arranged. For example, one or both of the front end 45 and the back end 47 could be completely closed so that either of the openings 111, 113 are omitted, or the openings could be otherwise shaped and arranged without departing from the disclosure.

Figure 7:
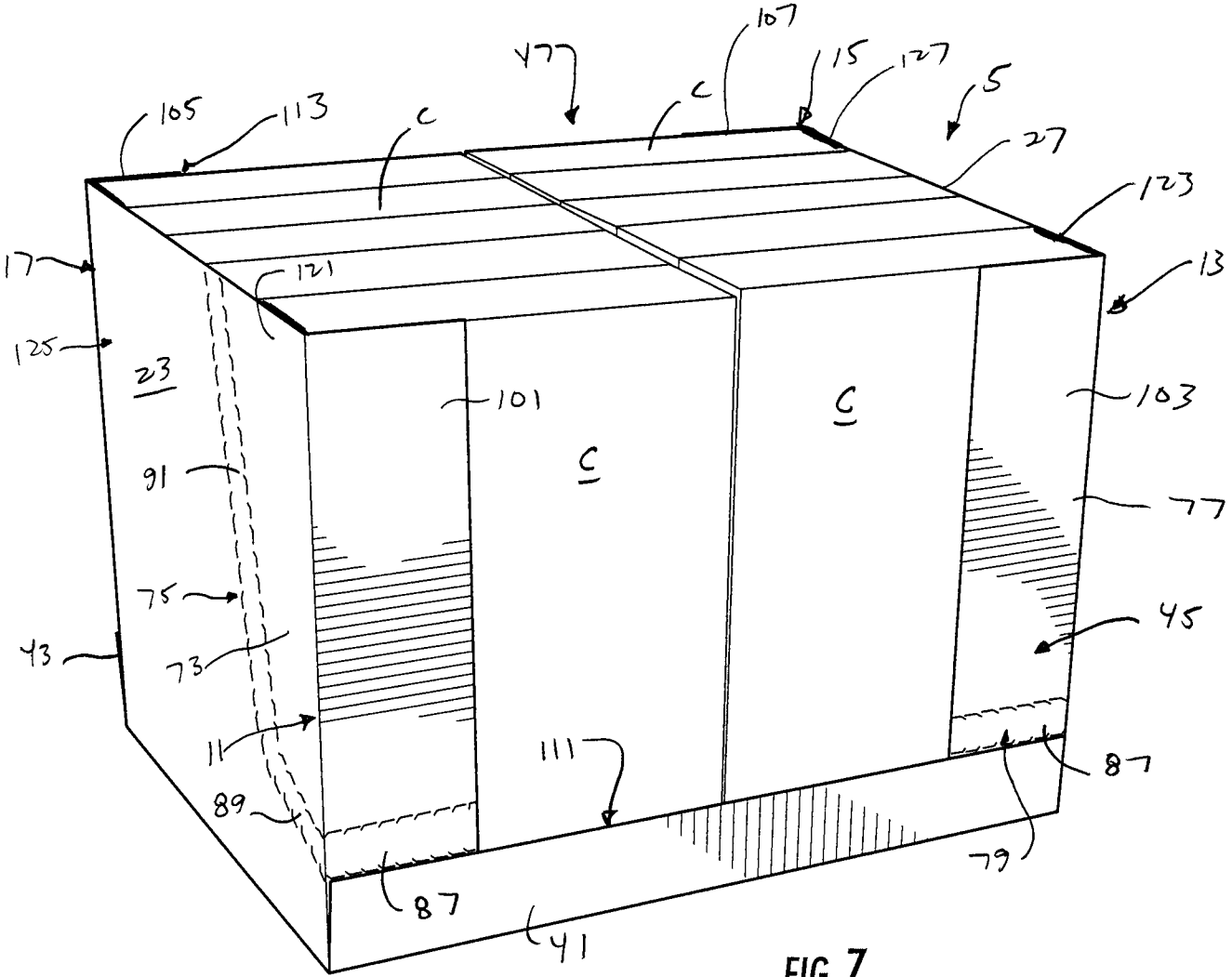
FIG. 7 is a perspective view of the carton of the first embodiment loaded with articles.

As shown in FIG. 6, containers C can be placed into the interior 7 (FIG. 5) of the carton 5. In one embodiment, retention straps S can be wrapped around the carton 5 and positioned to retain the containers C in the carton as the carton is shipped to a point-of-sale location or intermediate storage location. Alternatively, the carton 5 can be shipped to the point-of-sale location or other location without the use of retention straps S (FIG. 7) or the retention straps could be other retention features without departing from the disclosure.

Figure 8:
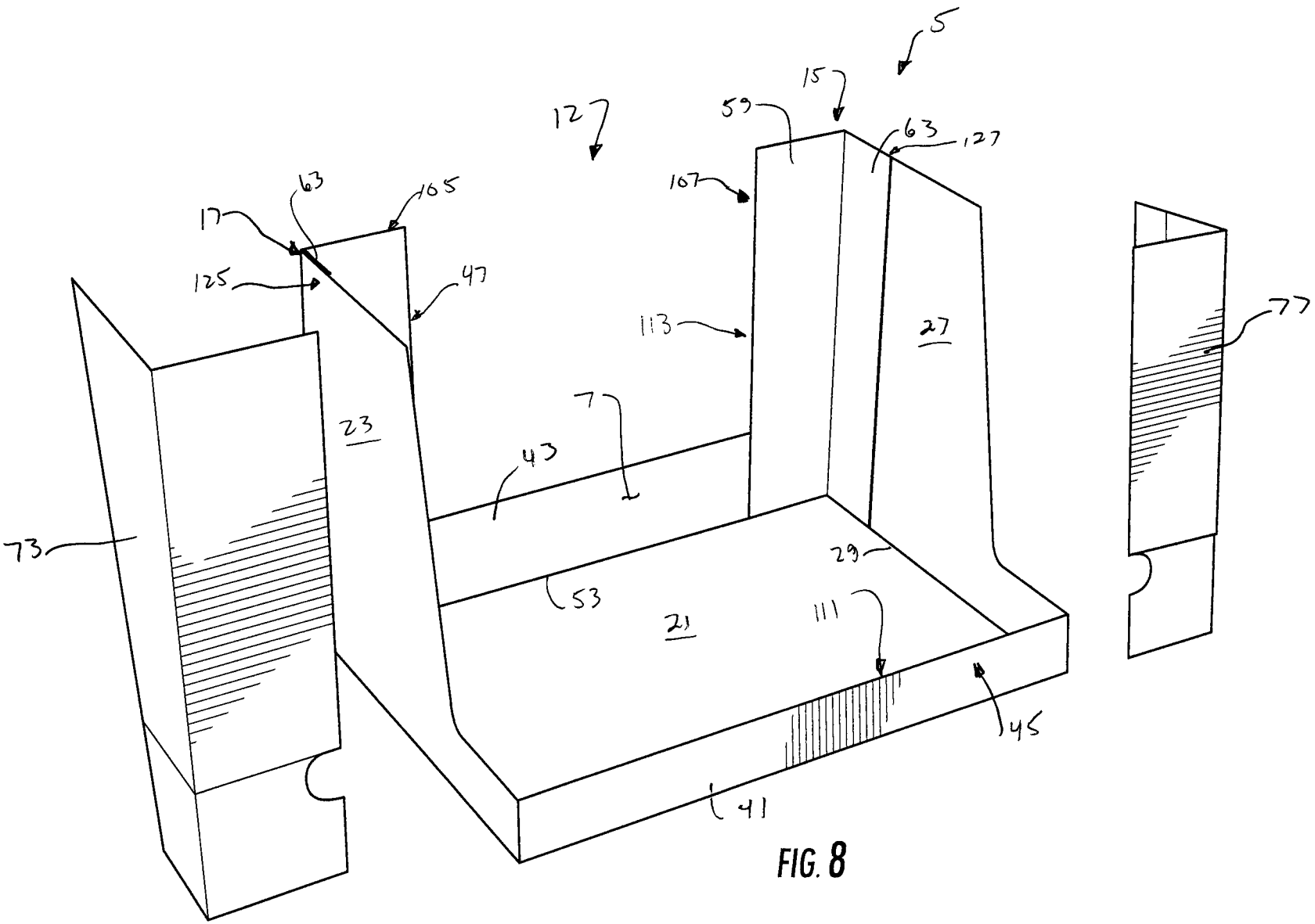
FIG. 8 is a perspective view of the carton of the first embodiment converted to a display configuration.
Figure 9:
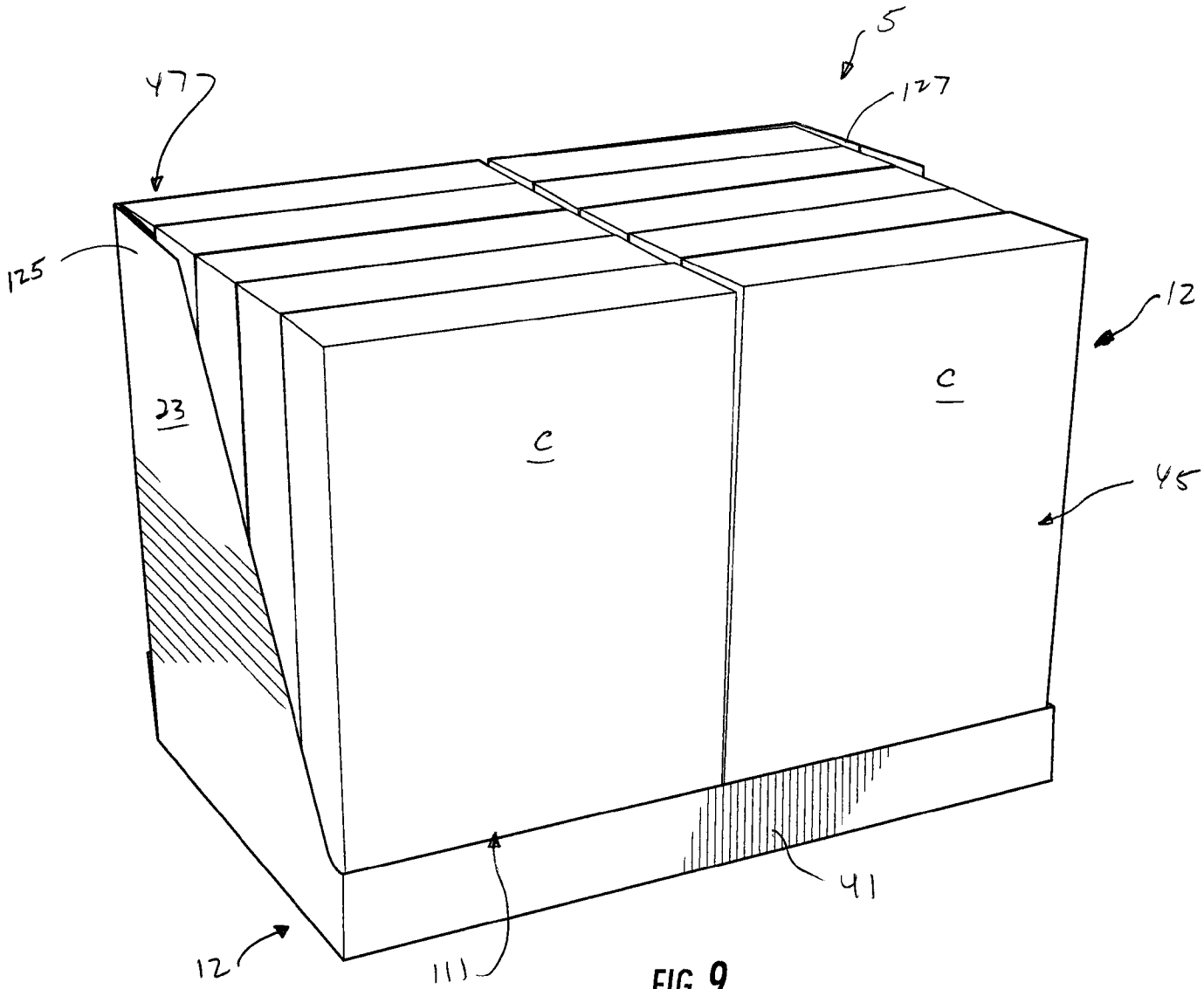
FIG. 9 is a perspective view of the carton of the first embodiment converted to a display configuration.

As shown in FIGS. 8 and 9, the carton 5 can be converted from a shipping configuration (FIG. 7) to a display configuration 12 (FIG. 9). The carton 5 in the display configuration 12 can be placed on the shelf of a point-of-sale vendor or other location, or the containers 5 can be removed from the carton and placed on the shelf. As shown in FIG. 8, one or both of the removable sections 73, 77 can be removed to convert the carton 5 from the shipping configuration to the display configuration 12. Each removable section 73, 77 is removed by accessing a respective tear strip 75, 79 at a respective access opening 81, 83 and grasping the tear strip and separating the first portion 87, second portion 89, and third portion 91 of the tear strip from the carton. Upon separation of the tear strips 75, 79 from the carton, the removable sections 73, 77 are free to be removed to expand the opening 111 at the front end 45 of the carton. The removable sections 73, 77 could be otherwise shaped, arranged, and/or configured and the back end 47 of the carton 5 could have one or more removable section without departing from the disclosure.

In one embodiment, the folding sequence for forming the blank 19 into the carton 5 can be performed on conventional folder/gluer equipment without modification to accommodate the blank and carton of the present disclosure. Alternatively, the folder/gluer equipment can be modified to accommodate the specific features of the blank 19 and/or carton 5 of the present disclosure. In one embodiment, the reinforced corners 11, 13, 15, 17 of the carton 5 each comprise a respective reinforced end panel 101, 103, 105, 107 and a respective reinforced portion 121, 123, 125, 127 of a respective side panel 23, 27. Each reinforced portion 121, 123, 125, 127 comprises the third portion 63 of a respective side end flap 33, 35, 37, 39 that is in face-to-face contact with a portion of a respective side panel 23, 27 that is adjacent respective fold line 51, 53. At each corner 11, 13, 15, 17 of the carton 5, the reinforced end panel 101, 103, 105, 107 and the reinforced portion 121, 123, 125, 127 of a side panel 23, 27 comprises two plies of material at a respective corner of the carton to reinforce and strengthen the carton. For example, the reinforced carton 5 provides increased stack strength and stability during shipping.

The blank 19 can be formed into the carton 5 by other folding steps or sequences, and the carton can have other features and be otherwise shaped, arranged, and/or configured without departing from the disclosure.

Figure 10:
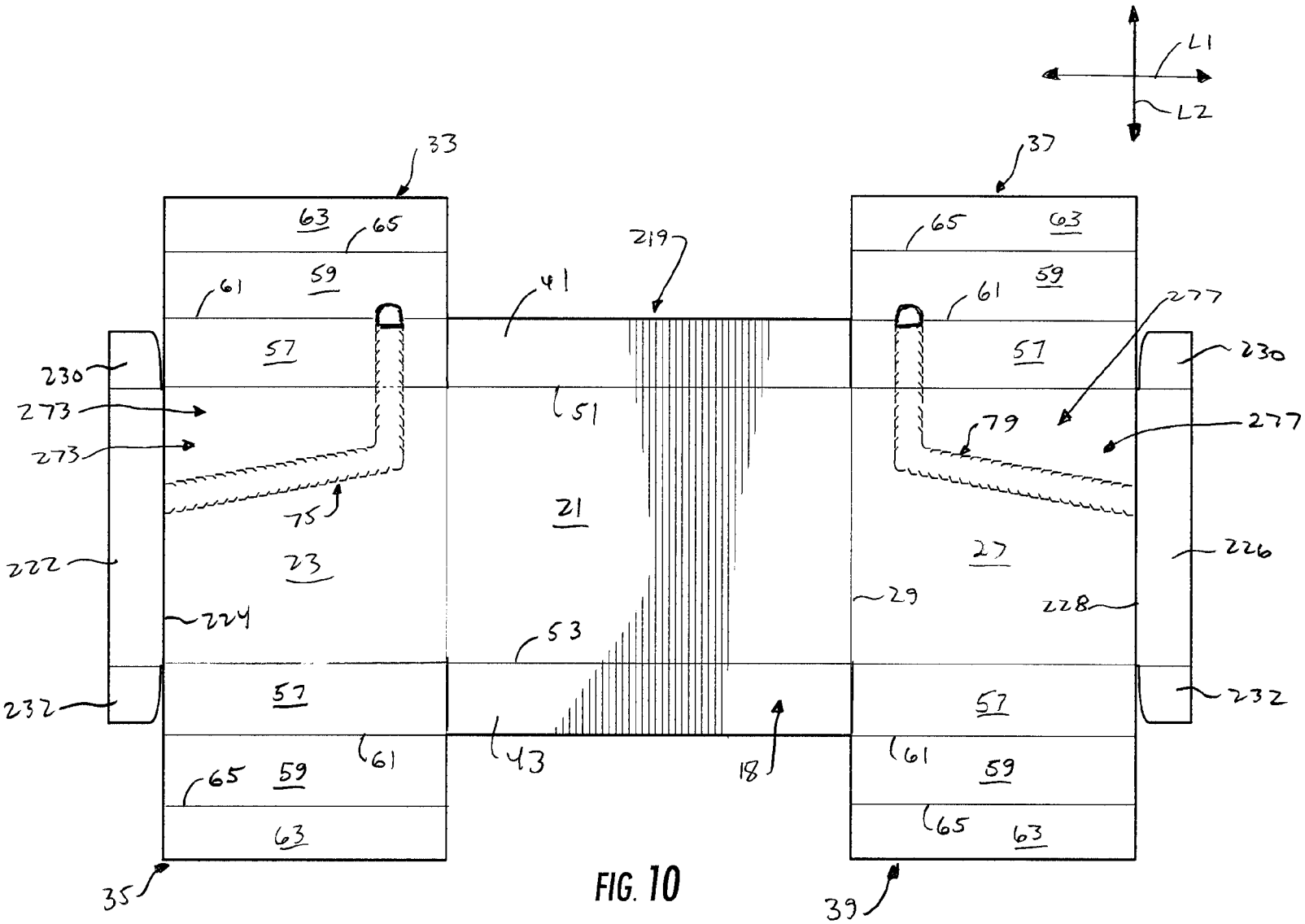
FIG. 10 is a plan view of an exterior surface of a blank for forming a carton according to a second embodiment of the disclosure.
Figure 11:
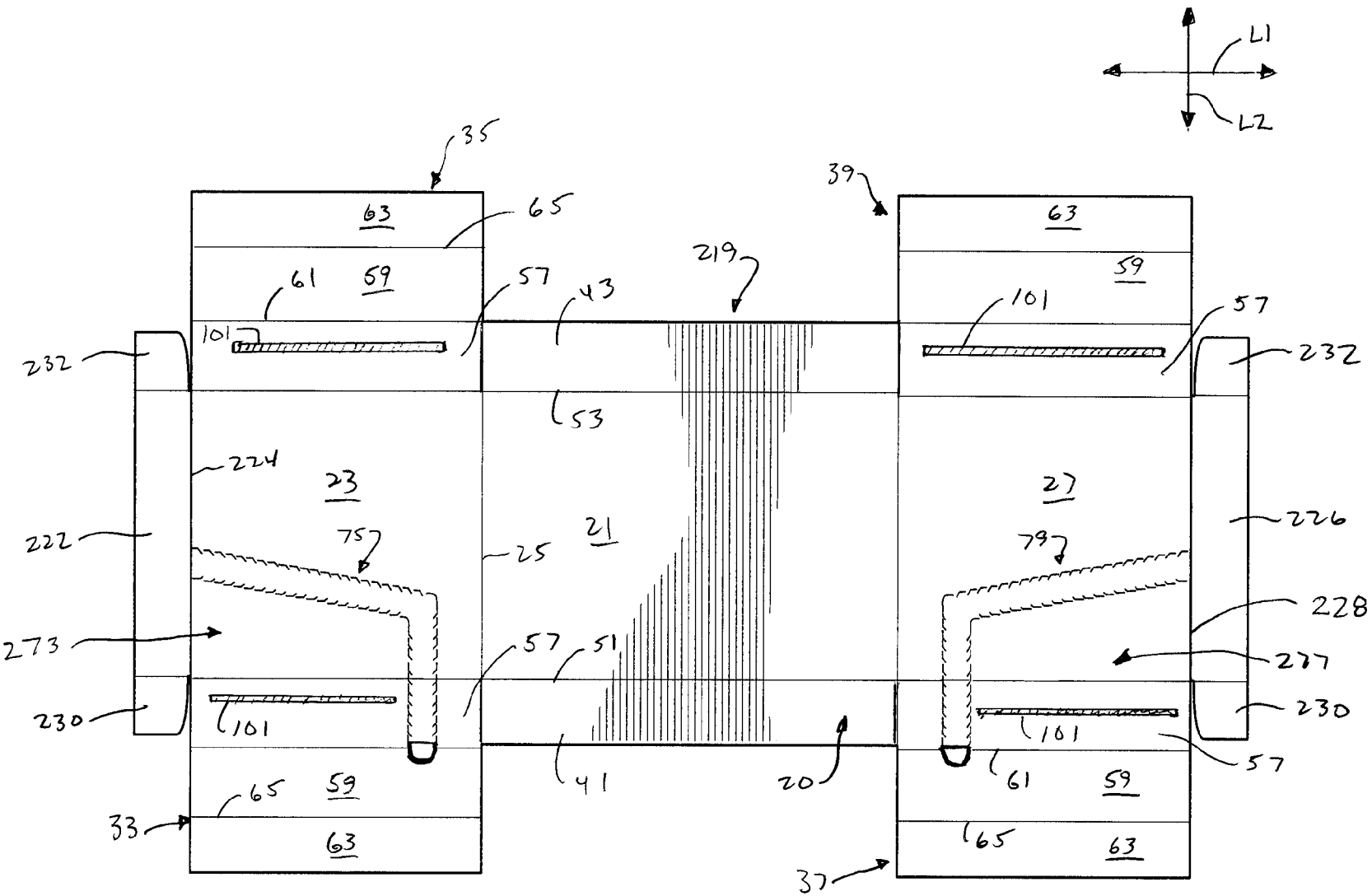
FIG. 11 is a plan view of an interior surface of the blank of FIG. 10.
Figure 12:
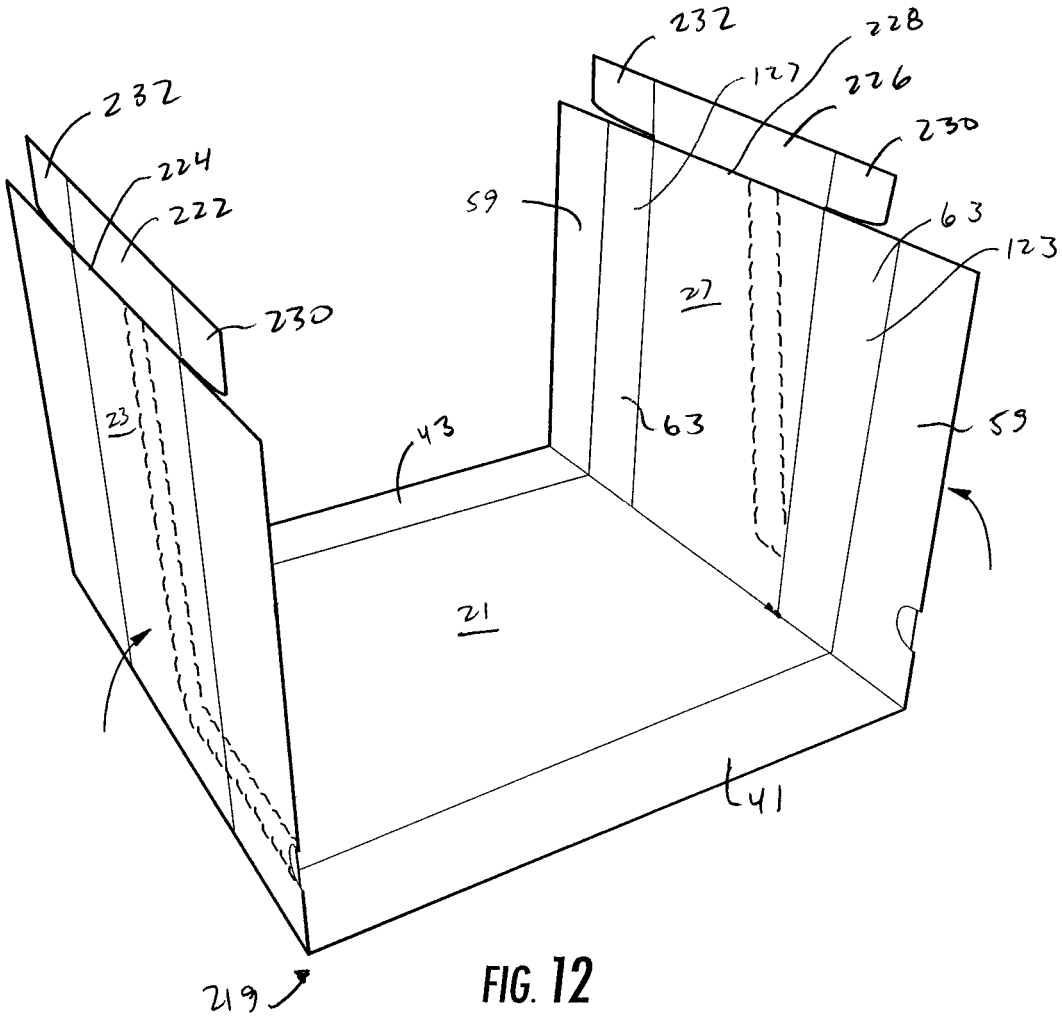
FIGS. 12-14 are various views of the blank and/or carton of the second embodiment in various states of assembly.
Figure 13:
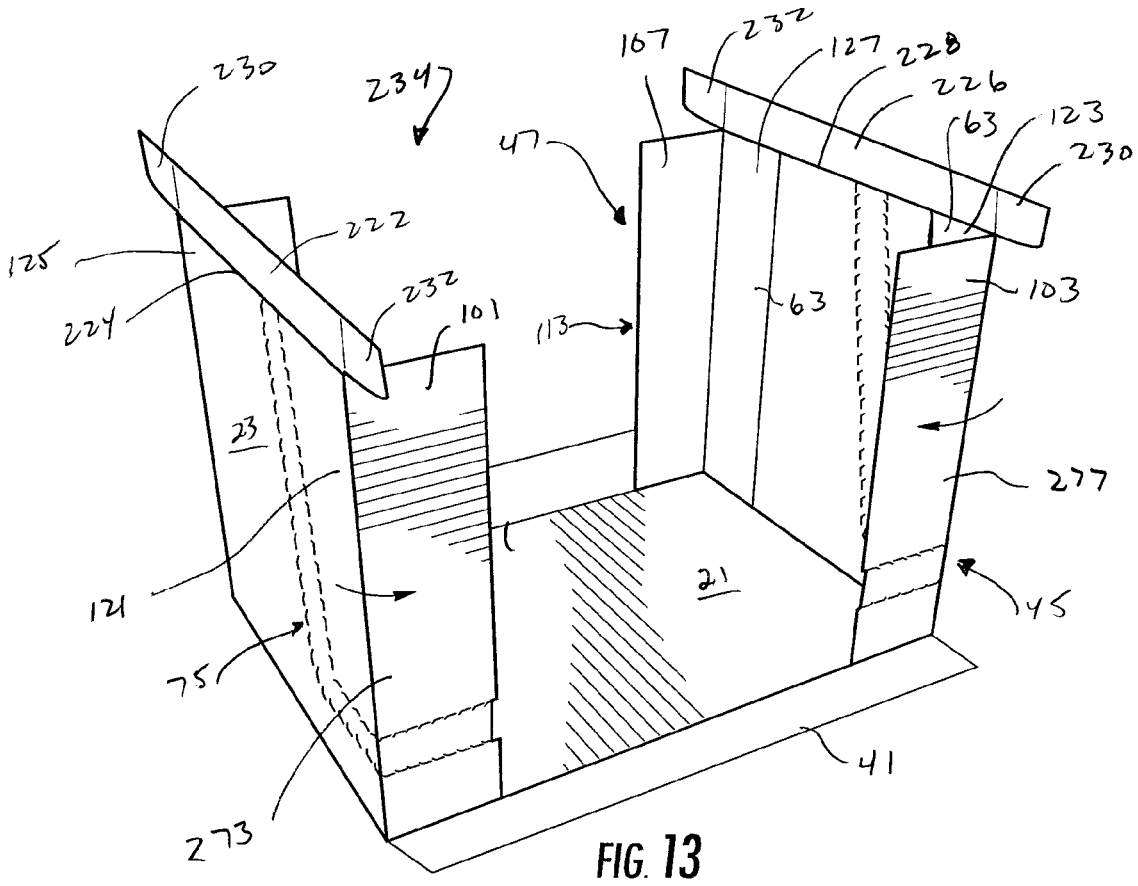

FIG. 10 shows a second embodiment of the blank 219 for being formed into carton 205 (FIG. 15) having similar features as the carton 5 of the first embodiment. Accordingly, similar or identical features, structure, or components of the embodiments are provided with like reference numbers between the two embodiments. As with the previous embodiment, the carton 205 has reinforced corners 11, 13, 15, 17 that increase the strength and structural integrity of the carton. In the second embodiment of FIGS. 10-16, the blank 219 and carton 205 have a first top panel 222 foldably connected to the first side panel 23 at a lateral fold line 224 and a second top panel 226 foldably connected to the second side panel 27 at a lateral fold line 228. Each of the top panels 222, 226 have two end flaps 230, 232 foldably connected at respective ends of the panel at extensions of the longitudinal fold lines 51, 53 in the top panels.

Figures 14, 15, 16:
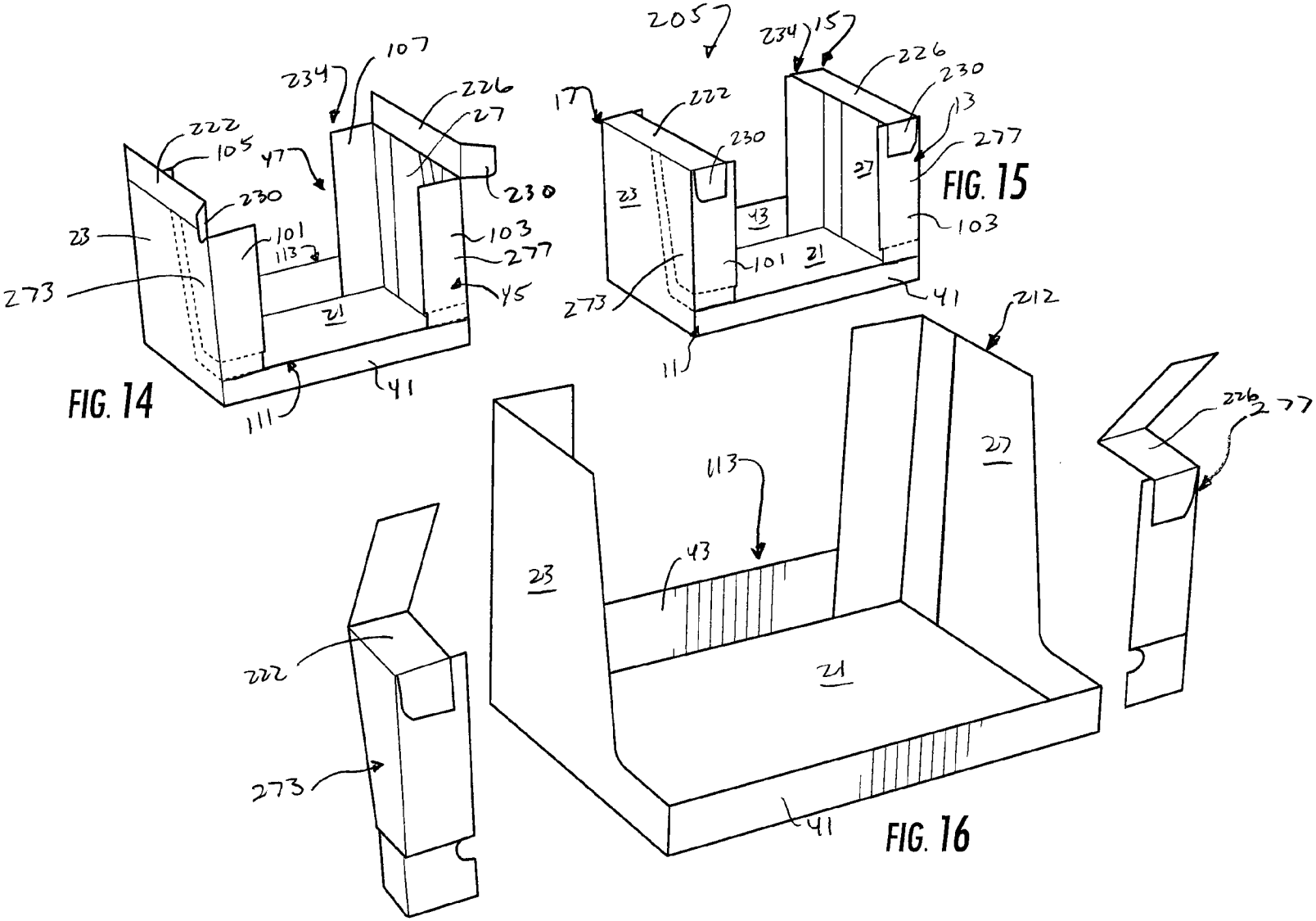
FIG. 15 is a perspective view of the carton of the second embodiment.
FIG. 16 is a perspective view of the carton of the second embodiment converted to a display configuration.

As shown in FIGS. 11-16, the carton 205 is formed from the blank 219 in a similar manner as described above for the carton 5 and blank 19 of the first embodiment. As shown in FIGS. 14 and 15, the top 234 of the carton 205 is partially closed by downwardly folding the top panels 222, 226 approximately 90 degrees relative to a respective side panel 23, 27 along a respective fold line 224, 228. The top end flaps 230, 232 are respectively downwardly folded and positioned in face-to-face contact with a respective reinforced end panel 101, 103, 105, 107 to cooperate with the reinforced end panels and the reinforced side portions 121, 123, 125, 127 to form a respective reinforced corner 11, 13, 15, 17 of the carton.

In the embodiment of FIG. 15, the top panels 222, 226 cooperate to retain the containers C in the shipping configuration of the carton. As shown in FIG. 16, the removable sections 273, 277 can be removed from the carton 205 in the shipping configuration to convert the carton to the display configuration 212. In one embodiment, the top panels 222, 226 and end flaps 230, 232 can be part of the removable sections 273, 277. The top panels 222, 226 can be separated from a respective side panel 23, 27 by tearing along a portion of the fold line 224, 228. The top panels 222, 226 and end flaps 230, 232 can be otherwise shaped, arranged, and/or configured without departing from the disclosure. Alternatively, the top panels 222, 226 can remain attached to the side panels 23, 27 upon removal of the removable sections 273, 277. Further, the removable sections 273, 277 could be otherwise shaped, arranged, configured, and/or omitted without departing from the disclosure.

In general and for each of the above-discussed blanks, the blank may be constructed from paperboard having a caliper of at least about 13, for example, so that it is heavier and more rigid than ordinary paper. The blank can also be constructed of other materials, such as cardboard, or any other material having properties suitable for enabling the carton to function at least generally as described above.

The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place, and the adhesive material can be replaced by, or supplemented with any suitable fastening devices.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, cut line, or the like. For example, a cut line can be a continuous slit or could be wider than a slit without departing from the present disclosure.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprises:

a plurality of panels that extends at least partially around an interior of the carton, wherein the interior is for containing the plurality of articles, the plurality of panels comprises a bottom panel, a first side panel foldably connected to the bottom panel, and a second side panel foldably connected to the bottom panel;

at least one end flap foldably connected to one of the first side panel and the second side panel, the at least one end flap comprises a first portion with a first edge and a second edge extending across the entire width of the at least one end flap, a second portion with a first edge and a second edge extending across the entire width of the at least one end flap, and a third portion with a first edge and a second edge extending across substantially the entire width of the at least one end flap, the first portion is foldably connected to the one of the first side panel and the second side panel along substantially the entire length of the first edge of the first portion, the second portion is foldably connected to the first portion along substantially the entire length of the second edge of the first portion and the first edge of the second portion, and the third portion is foldably connected to the second portion along substantially the entire length of the second edge of the second portion and the first edge of the third portion, the first edge and the second edge of the first portion, second portion, and third portion are substantially straight;

a removable panel at least partially defined by a tear strip in the at least one end flap and the one of the first side panel and the second side panel, the tear strip being accessible by an access opening in the at least one end flap adjacent the tear strip for accessing the tear strip to initiate separation of the removable panel from the carton, the carton having at least one reinforced corner that comprises a reinforced end panel and a reinforced portion of one of the first side panel and the second side panel, at least a portion of the reinforced corner is removable to convert the carton from a shipping configuration to a display configuration, the reinforced end panel comprises the second portion and the first portion of the at least one end flap that are in face-to-face contact, the reinforced portion of the one of the first side panel and the second side panel comprises the third portion of the at least one end flap that is in face-to-face contact with a portion of the one of the first side panel and the second side panel, and the access opening is in the second portion of the at least one side end flap, the tear strip having a first portion extending from the access opening across the first portion of the at least one side end flap, a second portion extending from the first portion of the tear strip into the one of the first side panel and the second side panel, and a third portion extending from the second portion of the tear strip to a free edge of the one of the first side panel and the second side panel.

2. The carton of claim 1, wherein the carton has an open top, an at least partially open front end, and an at least partially open back end.

3. The carton of claim 2 wherein the at least one end flap comprises two front end flaps foldably connected to a respective one of the first side panel and the second side panel at a front end of the carton.

4. The carton of claim 3 wherein the at least one reinforced corner comprises two front reinforced corners formed by a respective one of the two front end flaps.

5. The carton of claim 4 wherein the at least one end flap comprises two back end flaps foldably connected to a respective one of the first side panel and the second side panel at a back end of the carton.

6. The carton of claim 5 wherein the at least one reinforced corner comprises two back reinforced corners formed by a respective one of the two back end flaps.

7. The carton of claim 6 wherein the reinforced end panel of each of the front reinforced corners at least partially closes the front end of the carton and the reinforced end panel of each of the back reinforced corners at least partially closes the back end of the carton.

8. The carton of claim 7 further comprising a front bottom end flap and a back bottom end flap respectively foldably connected to the bottom panel, the front bottom end flap cooperating with the reinforced end panel of each of the front reinforced corners to at least partially close the front end of the carton and the back bottom end flap cooperating with the reinforced end panel of each of the back reinforced corners to at least partially close the back end of the carton.

9. The carton of claim 8 wherein the front end comprises an opening between the front reinforced corners and the front bottom end flap and the back end comprises an opening between the back reinforced corners and the back bottom end flap.

10. The carton of claim 1 wherein the first portion of the tear strip and the second portion of the tear strip extend generally in a first direction, and the third portion of the tear strip is oblique relative to the first direction.

11. The carton of claim 1 wherein the plurality of panels comprise a first top panel foldably connected to the first side panel and a second top panel foldably connected to the second side panel, the first top panel and the second top panel cooperating to at least partially close the top of the carton.

12. The carton of claim 11 wherein at least one of the first top panel and the second top panel comprises a top end flap, the top end flap being in face-to-face contact with the reinforced end panel forming the reinforced corner of the carton.

13. The carton of claim 1 wherein the second portion and the third portion extend from a top of the carton to the bottom panel.

14. The carton of claim 1 wherein the second portion and the third portion have a length corresponding to the height of the one of the first side panel and the second side panel.

15. A blank for forming a carton for containing a plurality of articles, the blank comprises:

a plurality of panels that are for forming an interior of the carton formed from the blank, the plurality of panels comprises a bottom panel, a first side panel foldably connected to the bottom panel, and a second side panel foldably connected to the bottom panel; and at least one end flap foldably connected to one of the first side panel and the second side panel, the at least one end flap comprises a first portion with a first edge and a second edge extending across substantially the entire width of the at least one end flap, a second portion with a first edge and a second edge extending across substantially the entire width of the at least one end flap, and a third portion with a first edge and a second edge extending across substantially the entire width of the at least one end flap, the first portion is foldably connected to the one of the first side panel and the second side panel along substantially the entire length of the first edge of the first portion, the second portion is foldably connected to the first portion along substantially the entire length of the second edge of the first portion and the first edge of the second portion, and the third portion is foldably connected to the second portion along substantially the entire length of the second edge of the second portion and the first edge of the third portion, the first edge and the second edge of the first portion, second portion, and third portion are substantially straight, a removable panel at least partially defined by a tear strip in the at least one end flap and the one of the first side panel and the second side panel, the tear strip comprises an access opening in the at least one end flap adjacent the tear strip for accessing the tear strip to initiate separation of the removable panel from the blank, the at least one end flap being for forming at least one reinforced corner of the carton formed from the blank that comprises a reinforced end panel and a reinforced portion of one of the first side panel and the second side panel, the reinforced end panel comprises the first portion and the second portion of the at least one end flap that are in face-to-face contact in the carton formed from the blank, and the reinforced portion of the one of the first side panel and the second side panel comprises the third portion of the at least one end flap that is in face-to-face contact with a portion of the one of the first side panel and the second side panel in the carton formed from the blank, the access opening is in the second portion of the at least one side end flap, the tear strip having a first portion extending from the access opening across the first portion of the at least one side end flap, a second portion extending from the first portion of the tear strip into the one of the first side panel and the second side panel, and a third portion extending from the second portion of the tear strip to a free edge of the one of the first side panel and the second side panel.

16. The blank of claim 15 wherein the at least one end flap comprises two front end flaps foldably connected to a respective one of the first side panel and the second side panel at a front marginal portion of the blank, the at least one reinforced corner comprises two front reinforced corners formed by a respective one of the two front end flaps in the carton formed from the blank.

17. The blank of claim 16 wherein the at least one end flap comprises two back end flaps foldably connected to a respective one of the first side panel and the second side panel at a back marginal portion of the blank, the at least one reinforced corner comprises two back reinforced corners formed by a respective one of the two back end flaps in the carton formed form the blank.

18. The blank of claim 17 further comprising a front bottom end flap and a back bottom end flap respectively foldably connected to the bottom panel, the front bottom end flap is for cooperating with the reinforced end panel of each of the front reinforced corners to at least partially close the front end of the carton formed from the blank and the back bottom end flap is for cooperating with the reinforced end panel of each of the back reinforced corners to at least partially close the back end of the carton formed from the blank.

19. The blank of claim 15 wherein the first portion of the tear strip and the second portion of the tear strip extend generally in a first direction, and the third portion of the tear strip is oblique relative to the first direction.

20. The blank of claim 15 wherein the plurality of panels comprise a first top panel foldably connected to the first side panel and a second top panel foldably connected to the second side panel, the first top panel and the second top panel are for cooperating to at least partially close the top of the carton formed from the blank.

21. The blank of claim 20 wherein at least one of the first top panel and the second top panel comprises a top end flap, the top end flap is for being in face-to-face contact with the reinforced end panel forming the reinforced corner of the carton formed from the blank.

22. A method of forming a carton for containing a plurality of articles, the method comprises:

obtaining a blank, the blank comprises a bottom panel, a first side panel foldably connected to the bottom panel, a second side panel foldably connected to the bottom panel, at least one end flap foldably connected to one of the first side panel and the second side panel, the at least one end flap comprises a first portion with a first edge and a second edge extending across substantially the entire width of the at least one end flap, a second portion with a first edge and a second edge extending across substantially the entire width of the at least one end flap, and a third portion with a first edge and a second edge extending across substantially the entire width of the at least one end flap, the first portion is foldably connected to the one of the first side panel and the second side panel along substantially the entire length of the first edge of the first portion, the second portion is foldably connected to the first portion along substantially the entire length of the second edge of the first portion and the first edge of the second portion, and the third portion is foldably connected to the second portion along substantially the entire length of the second edge of the second portion and the first edge of the third portion, the first edge and the second edge of the first portion, second portion, and third portion are substantially straight, the blank further comprises a removable panel at least partially defined by a tear strip in the at least one end flap and the one of the first side panel and the second side panel, the tear strip comprises an access opening in the at least one end flap adjacent the tear strip for accessing the tear strip to initiate separation of the removable panel from the blank, the access opening is in the second portion of the at least one side end flap, the tear strip having a first portion extending from the access opening across the first portion of the at least one side end flap, a second portion extending from the first portion of the tear strip into the one of the first side panel and the second side panel, and a third portion extending from the second portion of the tear strip to a free edge of the one of the first side panel and the second side panel;

positioning the blank to form the carton, the positioning comprises forming at least one reinforced corner comprising a reinforced end panel and a reinforced portion of one of the first side panel and the second side panel;

forming the reinforced end panel comprises placing the first portion and the second portion in face-to-face contact; and forming the reinforced portion of the one of the first side panel and the second side panel comprises placing the third portion of the at least one end flap in face-to-face contact with a portion of the one of the first side panel and the second side panel.

23. The method of claim 22 wherein the positioning the blank comprises forming an interior of the carton and the method further comprises loading the interior of the carton with a plurality of articles.

24. The method of claim 22 wherein the at least one end flap comprises two front end flaps foldably connected to a respective one of the first side panel and the second side panel at a front marginal portion of the blank, the forming at least one reinforced corner comprises forming two front reinforced corners from a respective one of the two front end flaps.

25. The method of claim 24 wherein the at least one end flap comprises two back end flaps foldably connected to a respective one of the first side panel and the second side panel at a back marginal portion of the blank, the forming at least one reinforced corner comprises forming two back reinforced corners from a respective one of the two back end flaps in the carton formed form the blank.

26. The method of claim 25 wherein the at least one end flap comprises a front bottom end flap and a back bottom end flap respectively foldably connected to the bottom panel, the method comprising positioning the front bottom end flap and the reinforced end panel of each of the front reinforced corners to at least partially close the front end of the carton, and positioning the back bottom end flap and the reinforced end panel of each of the back reinforced corners to at least partially close the back end of the carton.

27. The method of claim 22 wherein the method further comprises converting the carton from a shipping configuration to a display configuration by removing the removable panel.

28. The method of claim 27 wherein converting the carton comprises accessing the tear strip at the access opening and initiating separation of the removable panel from the blank.

29. The method of claim 22 wherein the plurality of panels comprise a first top panel foldably connected to the first side panel and a second top panel foldably connected to the second side panel, the positioning the blank to form the carton comprises positioning the first top panel and the second top panel to at least partially close the top of the carton formed from the blank.

30. The method of claim 29 wherein at least one of the first top panel and the second top panel comprises a top end flap, the forming the reinforced corner comprises positioning the top end flap in face-to-face contact with the reinforced end panel.

* * * * *